US009257755B2

(12) United States Patent
Hsieh et al.

(10) Patent No.: US 9,257,755 B2
(45) Date of Patent: Feb. 9, 2016

(54) APPARATUS FOR CONTROLLING ELECTRIC FIELD DISTRIBUTION BY UTILIZING SHORT TRACE STRUCTURES

(75) Inventors: Shih-Wei Hsieh, Taipei (TW); Han-Chang Lin, Kaohsiung (TW); Cho-Yi Lin, New Taipei (TW)

(73) Assignee: Shenzhen China Star Optoelectronics Technology Co., Ltd., Guangming District of Shenzhen, Shenzhen, Guangdong (CN)

( * ) Notice: Subject to any disclaimer, the term of this patent is extended or adjusted under 35 U.S.C. 154(b) by 551 days.

(21) Appl. No.: 13/555,208

(22) Filed: Jul. 23, 2012

(65) Prior Publication Data

US 2013/0249739 A1 Sep. 26, 2013

(30) Foreign Application Priority Data

Mar. 20, 2012 (TW) ..... 101109458 A

(51) Int. Cl.
*H01Q 1/24* (2006.01)
*H01Q 21/28* (2006.01)
*H01Q 3/24* (2006.01)

(52) U.S. Cl.
CPC ..... *H01Q 21/28* (2013.01); *H01Q 1/243* (2013.01); *H01Q 3/24* (2013.01)

(58) Field of Classification Search
None
See application file for complete search history.

(56) References Cited

U.S. PATENT DOCUMENTS 7,830,320 B2 * 11/2010 Shamblin et al. ..... 343/747
7,911,402 B2 * 3/2011 Rowson et al. ..... 343/745
8,154,467 B2 * 4/2012 Mitsui ..... 343/833
2002/0105471 A1 * 8/2002 Kojima et al. ..... 343/749
2004/0150568 A1 * 8/2004 Chiang et al. ..... 343/702
2005/0099343 A1 * 5/2005 Asrani et al. ..... 343/702
2006/0022890 A1 * 2/2006 Chiang et al. ..... 343/833

(Continued)

FOREIGN PATENT DOCUMENTS

CN 1816941 A 8/2006
JP 2006287986 A 10/2006

(Continued)

OTHER PUBLICATIONS

First Office Action and Search Report (English translation of Search Report enclosed); Chinese Patent Application No. 201210176766.6; Nov. 2, 2014; State Intellectual Property Office of the People's Republic of China.

(Continued)

*Primary Examiner* — Trinh Dinh
(74) *Attorney, Agent, or Firm* — Winston Hsu; Scott Margo

(57) ABSTRACT

An apparatus for controlling electric field distribution is provided, where the apparatus includes at least one portion of a portable electronic device, the portable electronic device includes a plurality of wireless communication functions respectively corresponding to different communication standards, and the plurality of wireless communication functions includes a mobile phone function and at least one other wireless communication function. The apparatus includes: a main antenna, connected to a first side of a PCB of the portable electronic device, for performing the mobile phone function; and a plurality of short trace structures, positioned at the first side of the PCB and connected to the PCB, wherein at least one of the plurality of short trace structures is selectively utilized as at least one short trace or utilized as at least one secondary antenna corresponding to the at least one other wireless communication function.

12 Claims, 7 Drawing Sheets

(56) References Cited

U.S. PATENT DOCUMENTS

| | | | | |
|---|---|---|---|---|
| 2008/0055163 | A1* | 3/2008 | Man | H01Q 1/2291 343/702 |
| 2008/0129639 | A1* | 6/2008 | Mitsugi | 343/876 |
| 2009/0179816 | A1 | 7/2009 | Chen et al. | |
| 2009/0224991 | A1* | 9/2009 | Rowson et al. | 343/747 |
| 2010/0026580 | A1 | 2/2010 | Tang | |
| 2011/0090126 | A1* | 4/2011 | Szini | H01Q 1/245 343/702 |
| 2011/0223858 | A1 | 9/2011 | Wong et al. | |
| 2013/0127670 | A1* | 5/2013 | Desclos et al. | 343/700 MS |

FOREIGN PATENT DOCUMENTS

| | | | |
|---|---|---|---|
| TW | 200623796 | A | 7/2006 |
| TW | 200840145 | A | 10/2008 |
| TW | 200939565 | A | 9/2009 |

OTHER PUBLICATIONS

First Office Action and Search Report (English translation of Search Report enclosed); Taiwanese Patent Application No. 101109458; Dec. 11, 2014; Taiwan Intellectual Property Office; Taipei, Taiwan.

* cited by examiner

TRP= 23.6dBm

TRP= 25.7dBm

APPARATUS FOR CONTROLLING ELECTRIC FIELD DISTRIBUTION BY UTILIZING SHORT TRACE STRUCTURES

BACKGROUND OF THE INVENTION

1. Field of the Invention

The present invention is related to radiation control of a portable electronic device, and more particularly, to an apparatus for controlling electric field distribution.

2. Description of the Prior Art

As the electronic circuit technology continues to develop in recent years, a variety of wireless communication functions are widely implemented in many applications. Therefore, the radiation control for these wireless communication functions becomes a very popular topic. Certain regions and countries of large product sales tend to have some regulations for products on the market. For instance, the product with the Federal Communications Commission (FCC) certification should comply with the relevant specifications when on the market. Similarly, the product labeled with Conformité Européenne (CE) should comply with relevant regulations when on the market.

According to the related art, the typical examples of the radiation-related indicators include: indicators of radiation energy absorbed by the body, especially the so-called specific absorption rate (referred to as "SAR value" hereinafter); and indicators of radiation energy interfering with hearing aids, especially the so-called hearing aid compatibility (referred to as "HAC value" hereinafter), wherein the measurement results of the SAR value and the HAC value tend to be affected by the total radiated power (referred to as "TRP value") in the wireless devices over the air performance (referred to as "OTA performance"), and the energy distribution of wireless devices.

The conventional solutions, such as reducing the OTA performance, attaching, using expensive absorbing materials or metal materials, etc., are frequently used in a variety of wireless devices to satisfy the related specifications of the HAC value and the SAR value, especially to enhance the HAC value and to reduce the SAR value. The conventional solutions often cause side effects, for example, resulting in poor communication quality, increasing cost and reducing design flexibility. Therefore, there is a need for a novel architecture for controlling surface current distribution of a wireless device to improve the performance of the wireless device in the HAC value and the SAR value by concentrating the electric field distribution of wireless devices on the antenna region.

SUMMARY OF THE INVENTION

One of the objectives of this invention is to provide an apparatus for controlling the electric field distribution to solve the problem mentioned above.

Another objective of the present invention is to provide an apparatus to control the electric field distribution for changing the electric field distribution of the portable electronic device, thereby reducing the chance of users being affected by radiation damage.

Another objective of the present invention is to provide an apparatus to control the electric field distribution for changing the electric field distribution of the portable electronic device, thereby reducing or avoiding interference to hearing aids.

The preferred embodiment of the present invention provides an apparatus to control the electric field distribution.

The apparatus includes at least a portion of a portable electronic device. The portable electronic device has a plurality of wireless communication functions corresponding to a plurality of different communication standards, respectively, wherein the plurality of wireless communication functions includes a mobile phone function and at least one other wireless communication function. The device includes: a main antenna, connected to a first side of a printed circuit board (PCB) of the portable electronic device, for performing the mobile phone function; and a plurality of short circuit structures positioned at the first side of the PCB and connected to the PCB, wherein at least one of the plurality of short circuit structures is selectively utilized as at least a short circuit or utilized as an auxiliary antenna corresponding to the at least one other wireless communication function.

One of the advantages of the present invention is that the apparatus used to control the electric field distribution has a plurality of short circuit structures disposed therein, where each of the short circuit structures has a simple structure and is easy to implement, and avoids the related technical problems at the same time. In addition, compared to the situation where the short circuit structures do not exist, the short circuit structures positioned at the first side of the PCB change the electric field distribution of the portable electronic device, thus reducing the electric field intensity at the sound output module.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
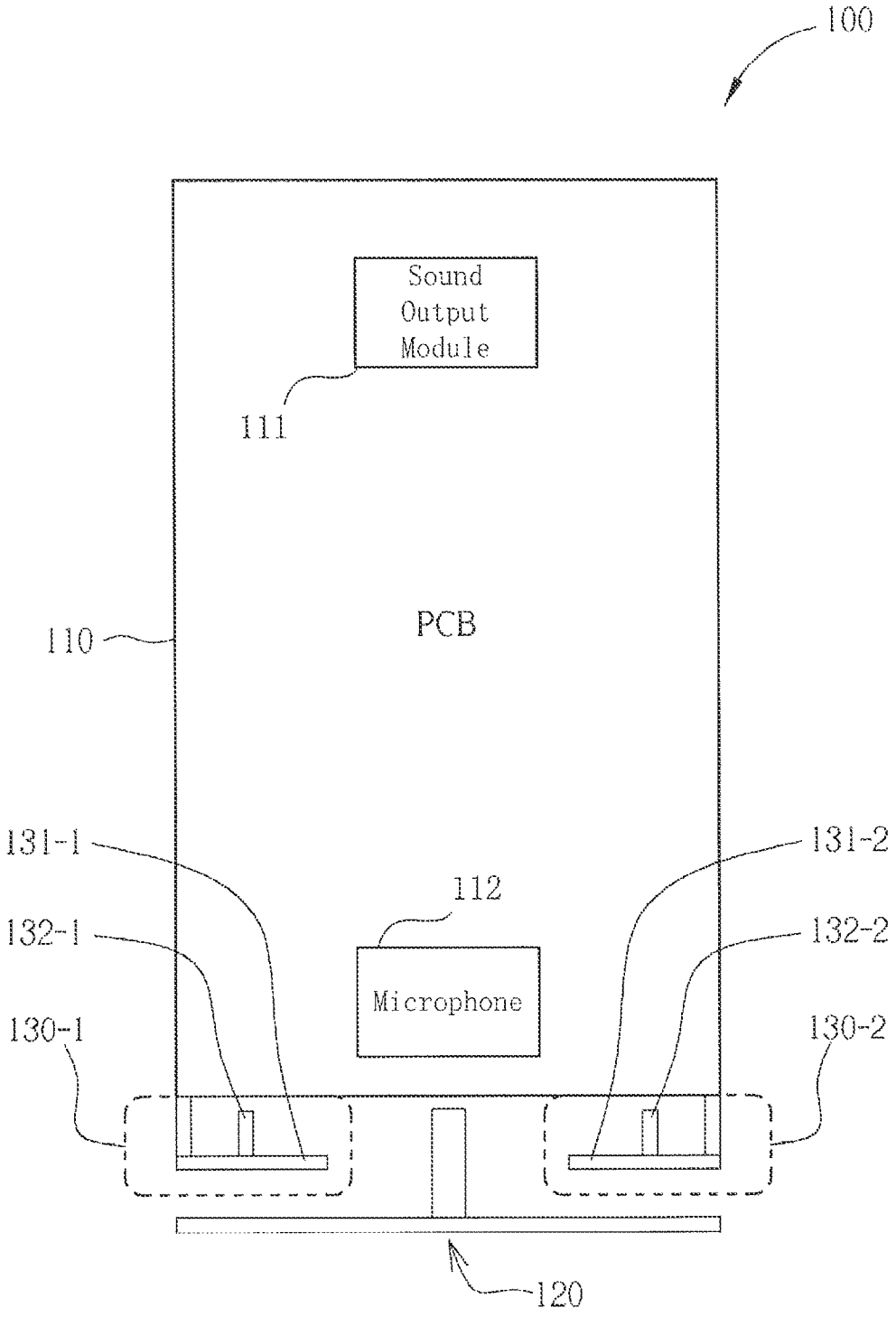
FIG. 1 is a diagram illustrating an apparatus for controlling the electric field distribution according to a first embodiment of the present invention.

FIG. 1 is a diagram illustrating an apparatus 100 for controlling the electric field distribution according to a first embodiment of the present invention. According to some embodiments, such as the first embodiment and alternative designs thereof, the apparatus 100 includes at least a portion of a portable electronic device (e.g., a portion of the portable electronic device, such as the PCB of the portable electronic device and components located on the PCB; or all of the portable electronic device, that is, the entire portable electronic device), wherein the portable electronic device has a plurality of wireless communication functions corresponding to different communication standards, respectively, and the wireless communication functions include a mobile phone function and at least one other wireless communication function. The at least one other wireless communication function mentioned above may include: a Bluetooth® (BT) wireless communication function, a wireless fidelity (WiFi) wireless communication function, a Global Positioning System (GPS) wireless communication function, and/or a Worldwide Interoperability for Microwave Access (WiMAX) wireless communication function.

As shown in FIG. 1, the apparatus 100 includes a PCB 110, a main antenna 120, and a plurality of short circuit structures like two short circuit structures 130-1 and 130-2, wherein the short circuit structure 130-1 has a first extension 131-1 and a second extension 132-1, and the short circuit structure 130-2 has a first extension 131-2 and a second extension 132-2. The PCB 110 is arranged to have various electronic components installed thereon. In addition, the main antenna 120 is connected to a first side of the PCB 110 of the portable electronic device (in this embodiment, the first side is the lower side of the PCB 110, that is, the lower side of the portable electronic device), particularly the middle of the first side of the PCB 110, and/or a position between the two short circuit structures 130-1 and 130-2, wherein the main antenna 120 is utilized for performing the mobile phone function. Furthermore, the short circuit structures 130-1 and 130-2 are positioned at the first side of the PCB 110 and connect to the PCB 110, wherein at least one of the short circuit structures (e.g., short circuit structures 130-1 and 130-2) is selectively utilized as at least a short circuit or utilized as at least an auxiliary antenna corresponding to the at least one other wireless communication function mentioned above. In practice, the main antenna 120 and the at least one auxiliary antenna mentioned above correspond to different carrier frequencies, respectively.

According to some embodiments, such as the first embodiment and certain alternative designs thereof, the PCB 110 can have a switch installed thereon, wherein the switch is arranged to selectively control whether the short circuit structures 130-1 and 130-2 are grounded or not. Particularly, according to some configuration schemes of the apparatus 100, among the short circuit structures (e.g., short circuit structures 130-1 and 130-2), any short circuit structure not selected to act as an auxiliary antenna is grounded; that is, such a short circuit structure not selected to act as an auxiliary antenna is utilized as a short circuit. For example, any one of the short circuit structures 130-1 and 130-2 that is not selectively utilized as an auxiliary antenna is grounded to act as a short circuit in the first case; if both of the short circuit structures 130-1 and 130-2 are not selectively utilized as auxiliary antennas, the short circuit structures 130-1 and 130-2 are both grounded to act as two short circuits in the second case; and if both of the short circuit structures 130-1 and 130-2 are selectively utilized as auxiliary antennas, the short circuit structures 130-1 and 130-2 are not grounded, and both are not utilized as short circuits in the third case. Particularly, in the third case, the short circuit structures 130-1 and 130-2 are arranged to act as two auxiliary antennas corresponding to the at least one other wireless communication function mentioned above.

According to some embodiments, such as the first embodiment and certain alternative designs thereof, the at least one of the short circuit structures has at least a first extension and at least a second extension. Particularly, according to some configuration schemes of the apparatus 100, in a case where at least one of the short circuit structures is arranged to act as at least one short circuit, the at least one first extension is arranged to act as a portion of the at least one short circuit. For example, in one case where the short circuit structure 130-1 is utilized as a short circuit, the first extension 131-1 is arranged to be a portion of the short circuit; and in another case where the short circuit structure 130-2 is arranged as a short circuit, the first extension 131-2 is arranged to be a portion of the short circuit. In addition, according to some configuration schemes of the apparatus 100, in a case where the at least one of the short circuit structures is arranged to act as at least an auxiliary antenna mentioned above, the at least one first extension is arranged to be at least a portion of the at least one auxiliary antenna mentioned above, and the at least one second extension mentioned above is arranged to act as at least a feed point of the at least one auxiliary antenna mentioned above. For example, in one case where the short circuit 130-1 is arranged to act as an auxiliary antenna, the first extension 131-1 is arranged to act as at least a portion of the auxiliary antenna, and the second extension 132-1 is arranged to act as a feed point of the auxiliary antenna; and in another case where the short circuit 130-2 is arranged to act as an auxiliary antenna, the first extension 131-2 is arranged to act as at least a portion of the auxiliary antenna, and the second extension 132-2 is arranged to act as a feed point of the auxiliary antenna.

According to some embodiments, such as the first embodiment and certain alternative designs thereof, a sound output module 111 (which may be a speaker close to user's ear while a user is using the mobile phone) of the portable electronic device is closer to a second side of the PCB 110 (e.g., the upper side of the PCB 110) with respect to the first side of the PCB 110 (e.g., the lower side of the PCB 110). Moreover, a microphone 112 of the portable electronic device is closer to the first side of the PCB 110 (e.g., the lower side of the PCB 110) with respect to the second side of the PCB 110 (e.g., the upper side of the PCB 110). Compared to the situation that the short circuit structures do not exist, the short circuit structures (e.g., short circuit structures 130-1 and 130-2) positioned at the first side of the PCB 110 would change the electric field distribution of the portable electronic device, thus reducing the electric field intensity at the sound output module 111. Therefore, the invention can solve problems of the related art and particularly enhance the HAC value and reduce the SAR value without introducing the above-mentioned side effects (e.g., poor communication quality, increased cost and reduced design flexibility).

FIG. 1 shows an electrically coupling/connecting relationship of the PCB 110, the main antenna 120 and the short circuit structures 130-1 and 130-2 on the ground layer (GND layer) instead of physical coupling/connection relationship. For example, the upper end of the main antenna 120 is the feed point and is therefore electrically connected to another layer of the PCB 110. However, due to FIG. 1 showing the electrically coupling/connecting relationship between the PCB 110 and the antenna 120 on the GND layer instead of the physical connection relationship, the upper end of the main antenna 120 in FIG. 1 is shown separate from the PCB 110. Besides, the second extensions 132-1 and 132-2 of the short circuit structures 130-1 and 130-2 respectively can be used as feed points, and are therefore electrically connected to another layer of the PCB 110. Because FIG. 1 shows the electrically coupling/connecting relationship between the PCB 110 and the short circuit structures 130-1 and 130-2 on the GND layer instead of the physical connection relationship, the second extensions 132-1 and 132-2 in FIG. 1 are shown separate from the PCB 110.

Figure 2:
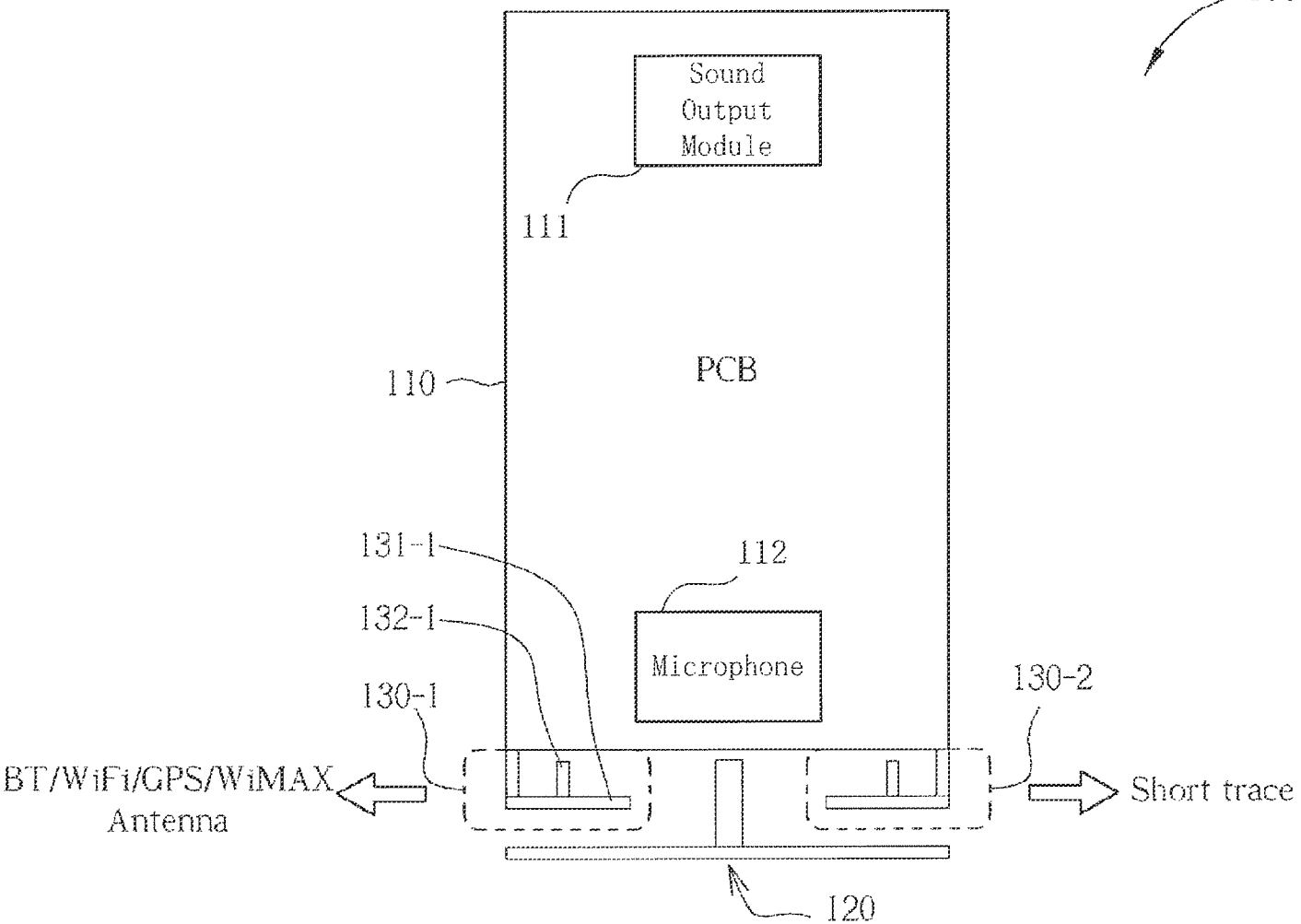
FIG. 2 shows a first configuration scheme of the apparatus in an embodiment in FIG. 1.

FIG. 2 shows a first configuration scheme of an embodiment of the apparatus 100 in FIG. 1. According to this embodiment, the short circuit structure 130-1 is selectively utilized as the auxiliary antenna (e.g., a BT antenna, a WiFi antenna, a GPS antenna or a WiMAX antenna that is labeled as "BT/WiFi/GPS/WiMAX antenna" in FIG. 2), and the short circuit structure 130-2 is selectively utilized as a short circuit. The similarities of this embodiment and the aforementioned embodiments/alternative designs are not repeated here for brevity.

Figure 3:
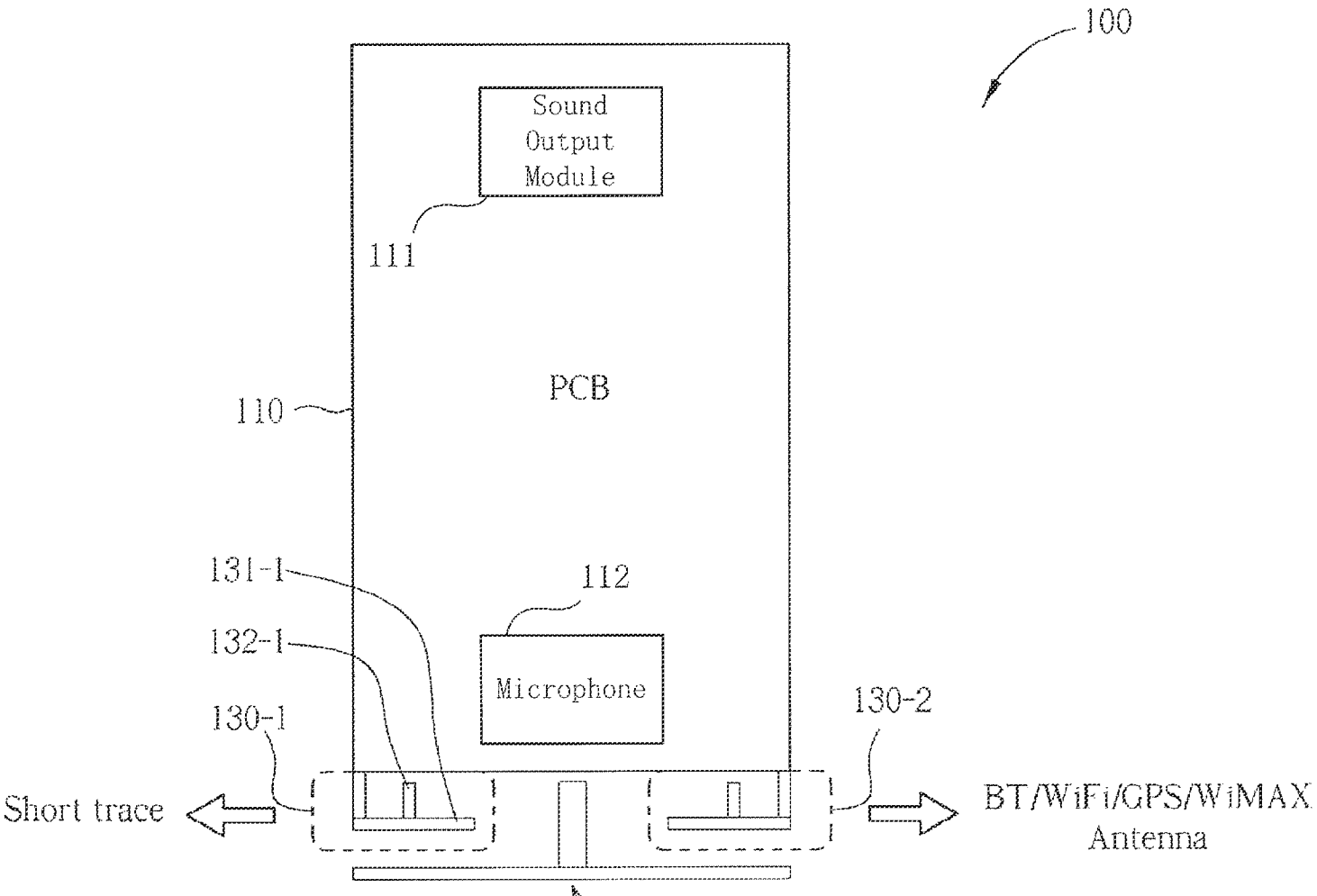
FIG. 3 shows a second configuration scheme of the apparatus in another embodiment in FIG. 1.

FIG. 3 shows a second configuration scheme of another embodiment of the apparatus 100 in FIG. 1. According to this embodiment, the short circuit structure 130-1 is selectively utilized as a short circuit, and the short circuit structure 130-2 is selectively utilized as the auxiliary antenna (e.g., a BT antenna, a WiFi antenna, a GPS antenna or a WiMAX antenna that is labeled as "BT/WiFi/GPS/WiMAX antenna" in FIG. 3). The similarities of this embodiment and the aforementioned embodiment/alternative designs are not repeated here for brevity.

Figure 4:
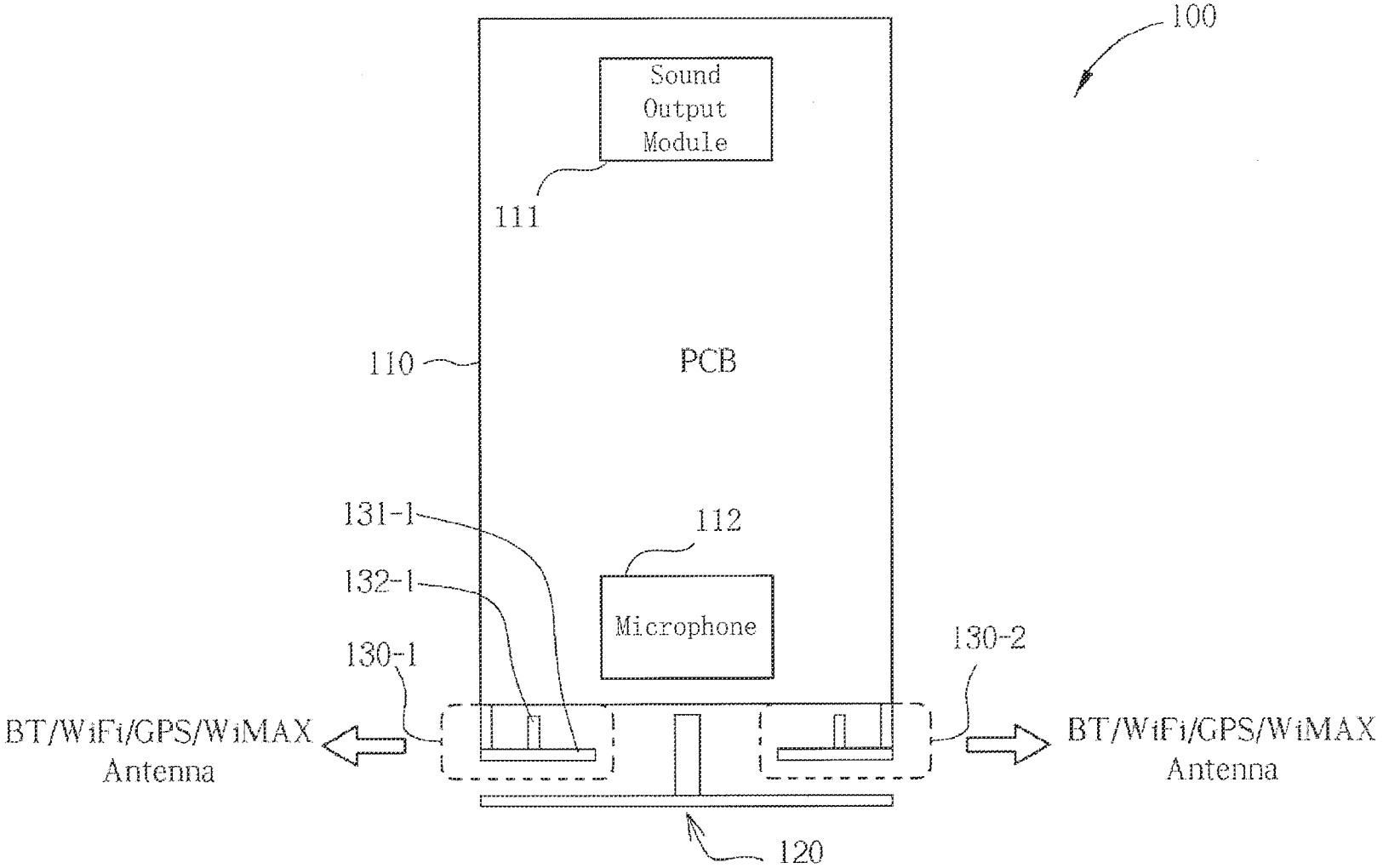
FIG. 4 shows a third configuration scheme of the apparatus in another embodiment in FIG. 1.

FIG. 4 shows a third configuration scheme of another embodiment of the apparatus 100 in FIG. 1. According to this embodiment, each of the short circuit structures 130-1 and 130-2 is selectively utilized as an auxiliary antenna (e.g., a BT antenna, a WiFi antenna, a GPS antenna or a WiMAX antenna that is labeled as "BT/WiFi/GPS/WiMAX antenna" in FIG. 4). The similarities of this embodiment and the aforementioned embodiments/alternative designs are not repeated here for brevity.

Figure 5:
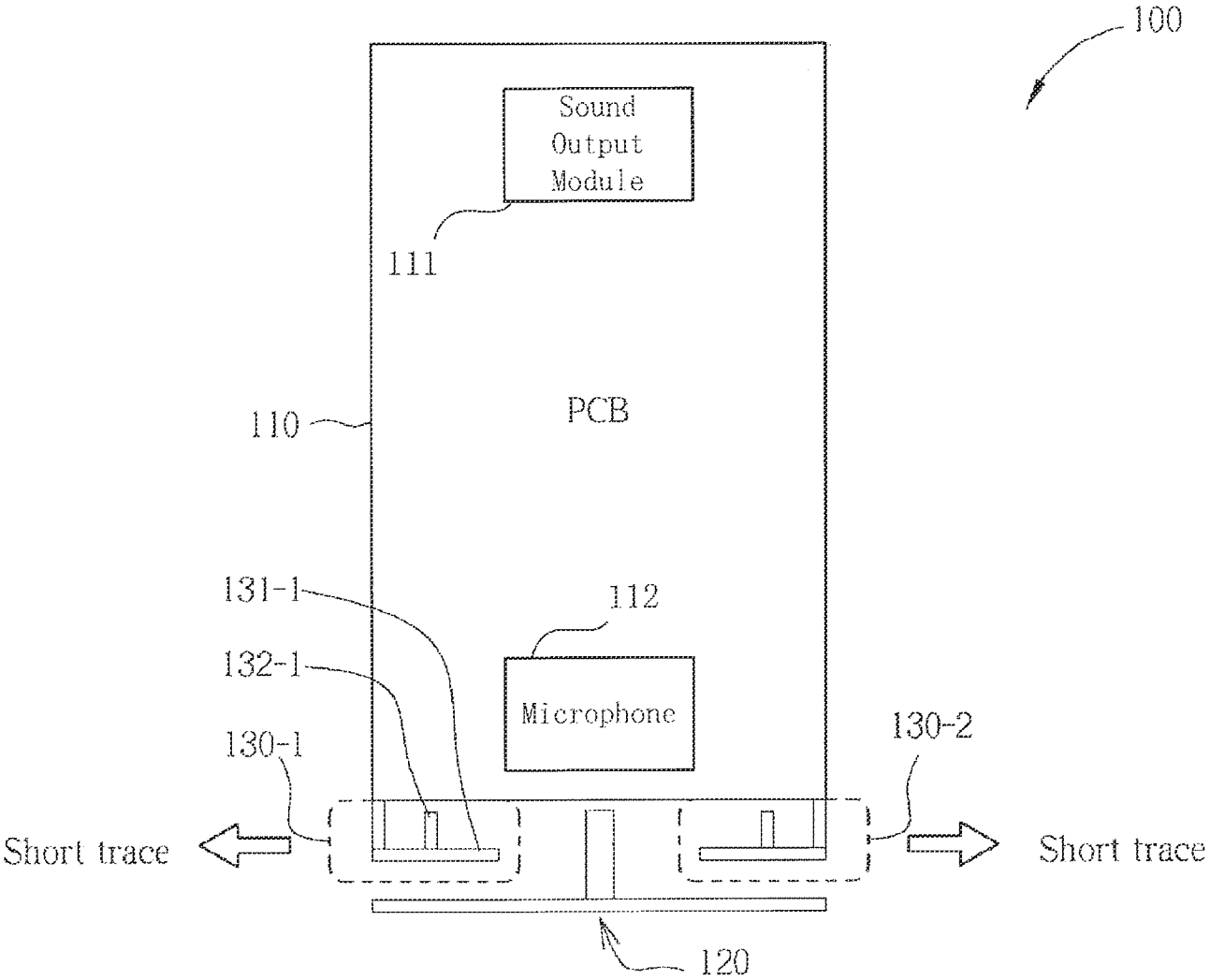
FIG. 5 shows a fourth configuration scheme of the apparatus in another embodiment in FIG. 1.

FIG. 5 shows a fourth configuration scheme of another embodiment of the apparatus 100 in FIG. 1. According to this embodiment, the short circuit structures 130-1 and 130-2 are selectively utilized as short circuits, respectively. The similarities of this embodiment and the aforementioned embodiments/alternative designs are not repeated here for brevity.

Figure 6:
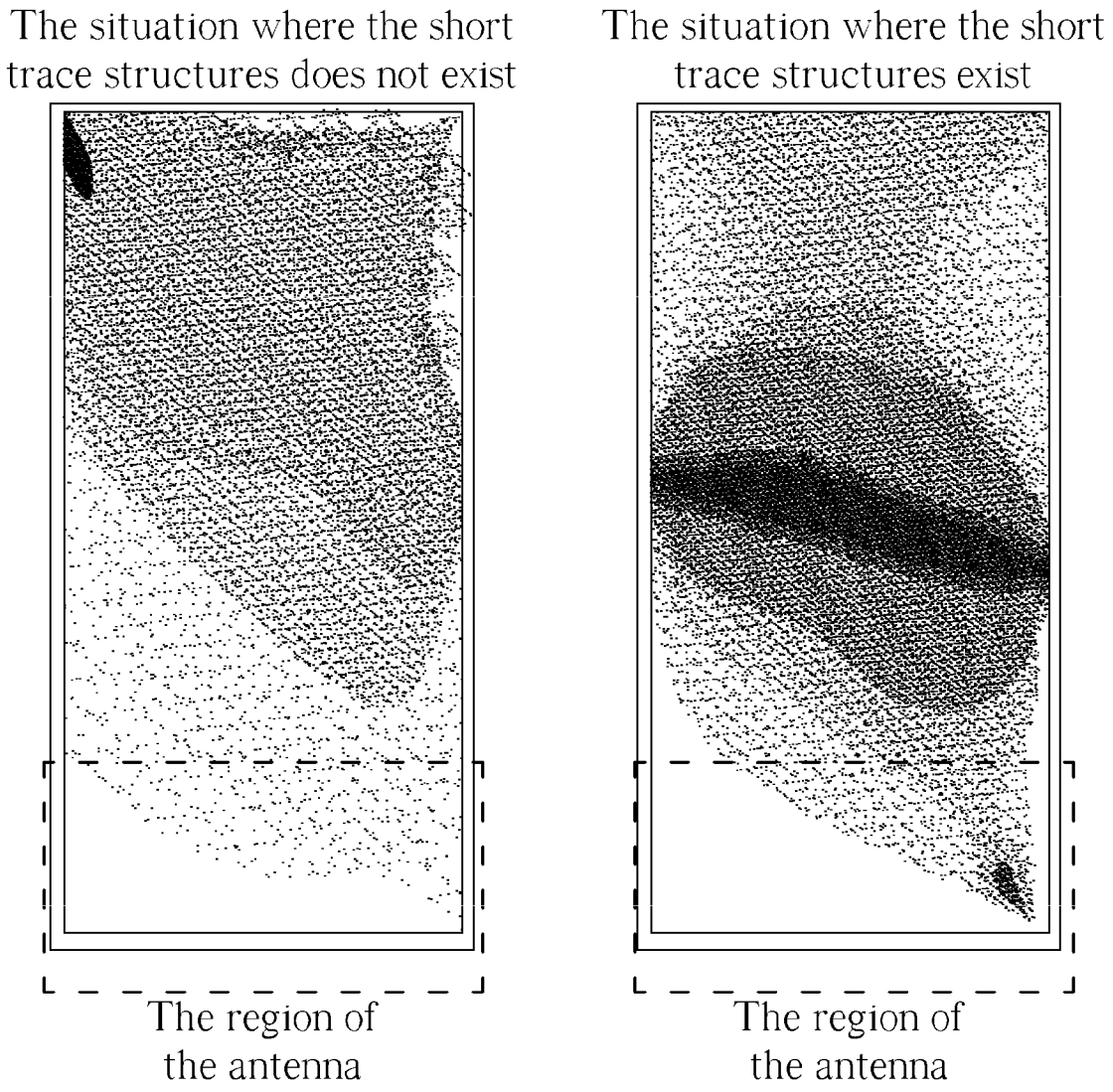
FIG. 6 shows the changes in the electric field distribution of the apparatus under different conditions in an embodiment in FIG. 1.

FIG. 6 shows the changes of the electric field distribution of an embodiment of the apparatus 100 in FIG. 1 under different conditions, wherein the darker shadow represents the weaker electric field intensity, and the lighter shadow represents the stronger electric field intensity.

According to this embodiment, the left part of FIG. 6 shows the electric field distribution corresponding to the absence of the short circuit structures, and the right part of FIG. 6 shows the electric field distribution corresponding to the presence of the short circuit structures. Compared to the situation that the short circuit structures do not exist, the short circuit structures positioned at the first side of the PCB 110 (e.g., the lower side of the PCB 110; also the lower side of FIG. 6 in this embodiment) change the electric field distribution of the portable electronic device, thus reducing the electric field intensity at the sound output module 111. For example, the sound output module 111 can be positioned in the center of the PCB 110. Therefore, the present invention can solve problems of the related art, and particularly enhance the HAC value and reduce the SAR value without introducing the above-mentioned side effects.

Figure 7:
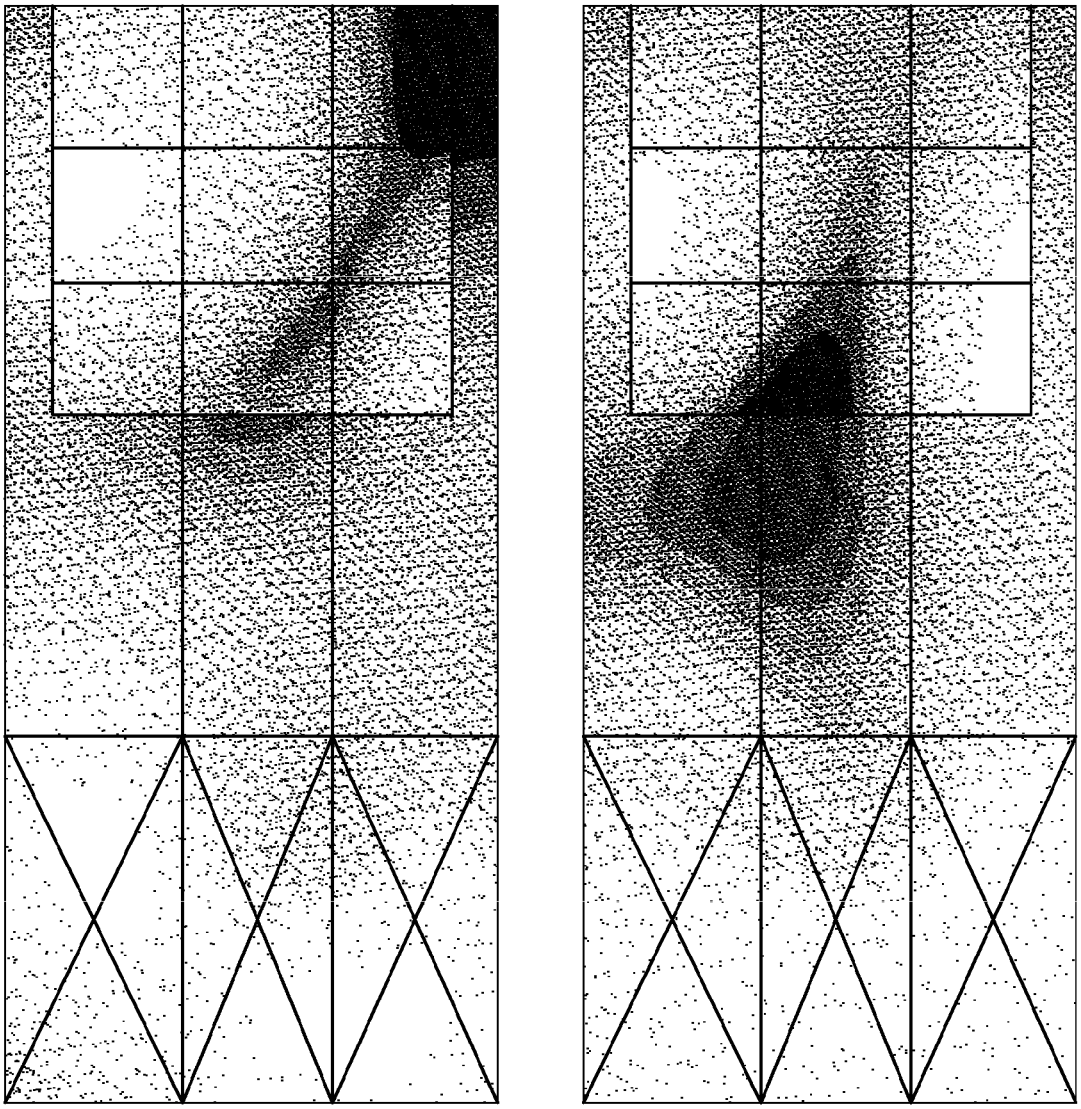
FIG. 7 shows the changes in the electric field distribution of the apparatus under different conditions in a second embodiment in FIG. 1.

FIG. 7 shows the changes of the electric field distribution of a second embodiment of the apparatus 100 in FIG. 1 under different conditions, wherein the darker shadow represents the weaker electric field intensity and the lighter shadow represents the stronger electric field intensity.

According to this embodiment, the left part of FIG. 7 shows the electric field distribution corresponding to the absence of the short circuit structures, and the right part of FIG. 7 shows the electric field distribution corresponding to the presence of the short circuit structures. Compared to the situation that the short circuit structures do not exist, the short circuit structures positioned at the first side of the PCB 110 (e.g., the lower side of the PCB 110; also the lower side of FIG. 7 in the embodiment) change the electric field distribution of the portable electronic device, thus reducing the electric field intensity at the sound output module 111. For example, the sound output module 111 can be located in the center of about the upper one third of the PCB 110, particularly the location of the center detection squares of the two 3×3 detection squares at the upper left corner and the upper right corner in FIG. 7. Therefore, the present invention can solve problems of the related art, and particularly enhance the HAC value and reduce the SAR value without introducing the above-mentioned side effects.

It is noted that, in this embodiment, the TRP value is 23.6 dBm in the situation that the short circuit structures do not exist, and the TRP value is 25.7 dBm in the situation that the short circuit structures exist. This means that, by implementing the short circuit structures, the present invention not only has no side effects like poor communication quality, but also enhances the HAC value and reduces the SAR value while enhancing the TRP value of the OTA performance. In addition, refer to the two 3×1 rectangular detection areas with X patterns at the lower left corner and the lower right corner of FIG. 7, where each rectangular detection area in this embodiment can be regarded as a region of an antenna or a neighboring region of the antenna. By implementing the short circuit structures, the present invention can control the surface current distribution of a wireless device, and concentrate the electric field distribution of the wireless device in the region of the antenna to enhance the performance of the HAC value and the SAR value of the wireless device. Therefore, the present invention has both of the communication quality of the wireless device and the performance of the HAC value and the SAR value taken into consideration.

One of the advantages of the present invention is that the apparatus for controlling the electric field distribution has the short circuit structures included therein, where each of the short circuit structures has a simple structure and is easy to implement, and also avoids the problems of the related art at the same time. In addition, compared to the situation that the short circuit structures do not exist, the short circuit structures positioned at the first side of the PCB changes the electric field distribution of the portable electronic device, thus reducing the electric field intensity at the sound output module. Moreover, the short circuit structures can control the electric field distribution of the portable electronic device, can be utilized as antennas of a variety of wireless communication standards corresponding to a plurality of different communication standards, respectively, and can be integrated and shield the microphone and other components below the antenna. Therefore, the present invention is particularly applicable to being implemented in the situation that the number of antennas is increased and the regulatory requirements are more stringent.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An apparatus for controlling electric field distribution, the apparatus including at least a portion of a portable electronic device, the portable electronic device having a plurality of wireless communication functions corresponding to a plurality of different communication standards, respectively, the plurality of wireless communication functions including a mobile phone function and at least one other wireless communication function, the apparatus comprising:

a main antenna, electrically connected to a first side of a printed circuit board (PCB) of the portable electronic device, the main antenna arranged for performing the mobile phone function; and a plurality of short circuit structures, positioned at the first side of the PCB and electrically connected to the PCB, wherein at least one of the plurality of short circuit structures is selected to be at least one auxiliary antenna corresponding to the at least one other wireless communication function, and other of the plurality of short circuit structures is selected to be a short circuit;

wherein a sound output module of the portable electronic device is closer to a second side of the PCB with respect to the first side of the PCB, the second side is opposite to the first side, the plurality of short circuit structures positioned at the first side of the PCB changes electric field distribution of the portable electronic device and the sound output module is closer to the second side of the PCB with respect to the first side of the PCB so as to reduce an electric field intensity at the sound output module.

2. The apparatus of claim 1, wherein the plurality of short circuit structures comprises two short circuit structures; and the main antenna is positioned at the middle of the first side of the PCB and/or positioned between the two short circuit structures.

3. The apparatus of claim 1, wherein among the plurality of short circuit structures, any short circuit structure not selectively utilized as an auxiliary antenna is grounded.

4. The apparatus of claim 1, wherein the main antenna and the at least one auxiliary antenna correspond to different carrier frequencies, respectively.

5. The apparatus of claim 1, wherein the at least one of the plurality of short circuit structures comprises a first short circuit structure; and the plurality of short circuit structures comprises a second short circuit structure, and the second short circuit structure is utilized as a short circuit.

6. The apparatus of claim 1, wherein the at least one of the plurality of short circuit structures comprises a first short circuit structure and a second short circuit structure; and the first short circuit structure and the second short circuit structure are selectively utilized as two short circuit or utilized as two auxiliary antennas corresponding to the at least one other wireless communication function.

7. The apparatus of claim 1, wherein the at least one of the plurality of short circuit structures comprises at least a first extension and at least a second extension; and in a case where the at least one of the plurality of short circuit structures is utilized as the least one short circuit, the at least one first extension is arranged to be a portion of the at least one short circuit.

8. The apparatus of claim 1, wherein the at least one of the plurality of short circuit structures comprises at least one first extension and at least one second extension; and in a condition that the at least one of the plurality of short circuit structures is utilized as the at least one auxiliary antenna, the at least one first extension is utilized as at least a portion of the at least one auxiliary antenna.

9. The apparatus of claim 8, wherein in a case where the at least one of the plurality of short circuit structures is utilized as the at least one auxiliary antenna, the at least one second extension is utilized as at least a feed point of the at least one auxiliary antenna.

10. The apparatus of claim 1, wherein a microphone of the portable electronic device is closer to the first side of the PCB with respect to a second side of the PCB.

11. The apparatus of claim 1, wherein the main antenna comprises a first portion and a second portion, the first portion is parallel to the first side of the PCB, and the second portion is perpendicular to the first portion and the first side of the PCB.

12. The apparatus of claim 11, wherein each of the plurality of short circuit structures comprises a first extension and a second extension, the first extension is parallel to the first side of the PCB and the first portion of the main antenna, and the second extension is perpendicular to the first extension and the first side of the PCB.

* * * * *